US007678172B2

(12) United States Patent
Batterham et al.

(10) Patent No.: US 7,678,172 B2
(45) **Date of Patent: *Mar. 16, 2010**

(54) MICROWAVE TREATMENT OF ORES

(75) Inventors: Robin John Batterham, Parkville (AU); Lucy Esdaile, Fitzroy (AU); Raymond Walter Shaw, Carlton North (AU); Christopher Robin Cross, South Wales (GB)

(73) Assignee: Technological Resources Pty Ltd, Melbourne (AU)

( * ) Notice: Subject to any disclaimer, the term of this patent is extended or adjusted under 35 U.S.C. 154(b) by 28 days.

This patent is subject to a terminal disclaimer.

(21) Appl. No.: 10/516,431

(22) PCT Filed: May 30, 2003

(86) PCT No.: PCT/AU03/00681

§ 371 (c)(1),
(2), (4) Date: Aug. 31, 2005

(87) PCT Pub. No.: WO03/102250

PCT Pub. Date: Dec. 11, 2003

(65) Prior Publication Data

US 2006/0096415 A1 May 11, 2006

(30) Foreign Application Priority Data

May 31, 2002 (AU) ..... PS2734

(51) Int. Cl.
*C22B 9/22* (2006.01)
*C22B 15/00* (2006.01)

(52) U.S. Cl. ..... 75/10.13; 75/419; 75/641

(58) Field of Classification Search ..... 75/10.13, 75/419, 641
See application file for complete search history.

(56) References Cited

U.S. PATENT DOCUMENTS 3,261,959 A * 7/1966 Moe et al. ..... 219/700
4,313,573 A * 2/1982 Goldberger et al. ..... 241/1

(Continued)

FOREIGN PATENT DOCUMENTS

CA 2277383 1/2001

(Continued)

OTHER PUBLICATIONS

Salsman et al., "Short-Pulse Microwave Treatment of Disseminated Sulfide Ores", Minerals Engineerig, vol. 9, No. 1 pp. 43-54, 1996.*

(Continued)

*Primary Examiner*—George Wyszomierski
*Assistant Examiner*—Tima M McGuthry-Banks
(74) *Attorney, Agent, or Firm*—The Webb Law Firm

(57) ABSTRACT

A method of treating ore particles to facilitate subsequent processing of the ore particles to recover valuable components from the ore is disclosed. The method includes exposing the ore particles to microwave energy and causing structural alteration of the ore particles. In one embodiment structural alteration is achieve without significantly altering the mineralogy, i.e., composition, of the ore. In another embodiment structural alteration is achieved with minimal change to the sizes of the ore particles. In another embodiment the method includes exposing the ore particles to short duration, high energy pulses of microwave energy.

14 Claims, 1 Drawing Sheet

U.S. PATENT DOCUMENTS

| | | | | |
|---|---|---|---|---|
| 4,324,582 | A * | 4/1982 | Kruesi et al. | 75/10.13 |
| 6,592,644 | B2 * | 7/2003 | Beckmann | 75/10.13 |
| 7,476,829 | B2 | 1/2009 | Kingman | |
| 2003/0029944 | A1 * | 2/2003 | Flinn et al. | 241/1 |

FOREIGN PATENT DOCUMENTS

| | | | |
|---|---|---|---|
| GB | 2 198 242 | A * | 6/1988 |
| WO | WO 92/18249 | | 10/1992 |
| WO | WO 02/092162 | | 11/2002 |

OTHER PUBLICATIONS

Haque, Kazi E., "Microwave energy for mineral treament process—a brief review", Int. J. Miner. Process. 57 (1999) 1-24.*

* cited by examiner

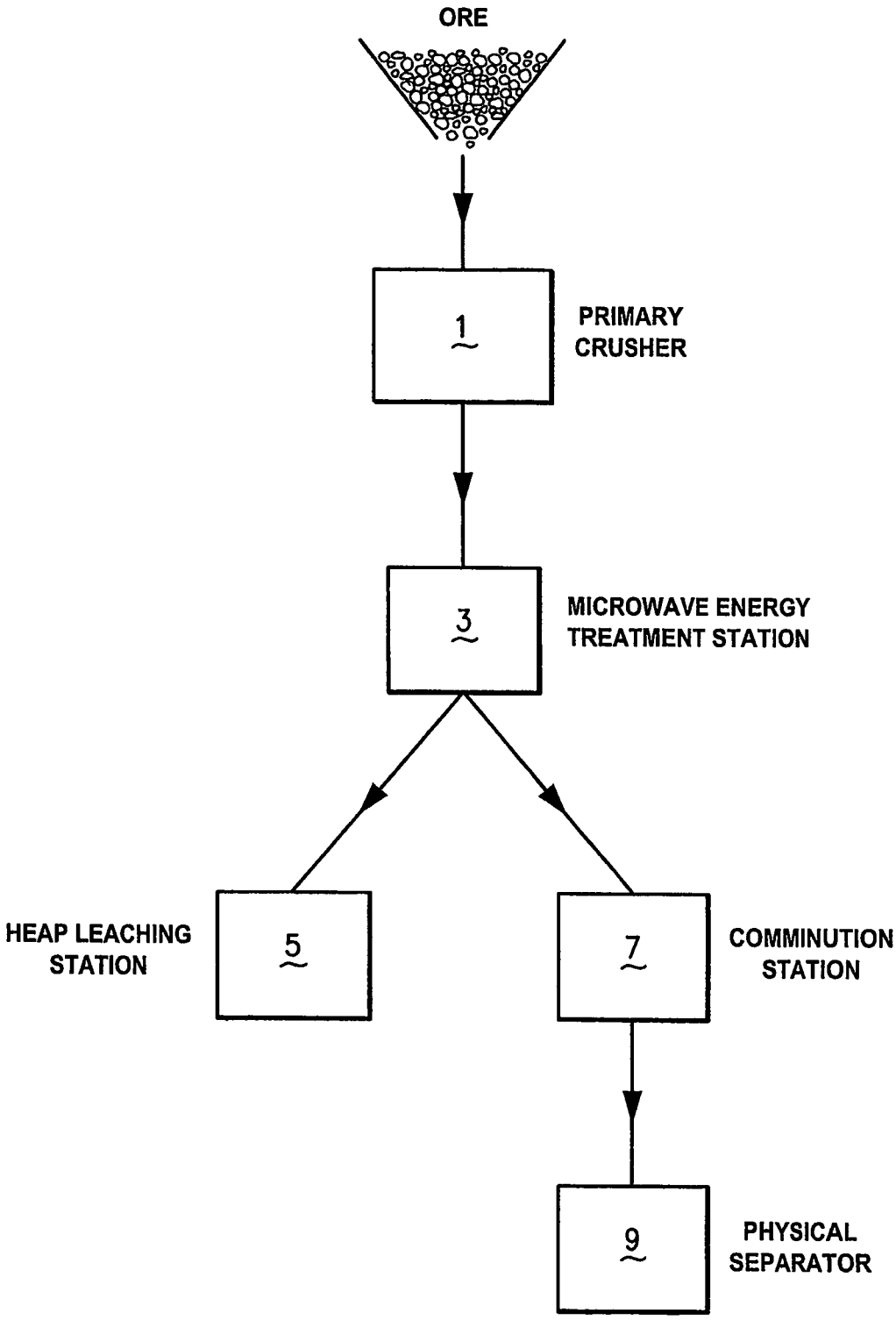
ORE
1
PRIMARY CRUSHER
3
MICROWAVE ENERGY TREATMENT STATION
HEAP LEACHING STATION
5
7
COMMINUTION STATION
9
PHYSICAL SEPARATOR

MICROWAVE TREATMENT OF ORES

BACKGROUND OF THE INVENTION

1. Field of the Invention

The present invention relates to treating ores with microwave energy to facilitate subsequent processing of the ores.

The present invention relates particularly, although by no means exclusively, to using microwave energy to treat ores to facilitate subsequent processing of the ores to recover valuable components, such as metals from the ores.

2. Description of the Prior Art

There have been a number of proposals to use microwave energy in a range of mining applications, such as comminution of ores, and there is on-going research and development work into these mining applications. However, these proposals have not been successfully used because of difficulties with (a) the high total power needed, (b) constructing a suitable arrangement to expose ores to microwaves, and (c) controlling the level of microwave exposure to avoid unwanted changes in the minerals and undesirable changes in the ore particles themselves.

An object of the present invention is to provide a microwave energy-based method of treating ores to facilitate subsequent processing of the ores to recover valuable components such as metals from the ores.

SUMMARY OF THE INVENTION

In general terms, according to the present invention there is provided a method of treating ore particles to facilitate subsequent processing of the ore particles, for example to recover a valuable component such as a metal from the ore particles, the method including exposing the ore particles to microwave energy and causing structural alteration of the ore particles.

Structural alteration of the ore particles is the result of differences in thermal expansion of minerals within ore particles, as a consequence of exposure to microwave energy, resulting in regions of high stress/strain within the ore particles and leading to micro-cracking or other physical changes within the ore particles.

In a specific example, structural alteration of the ore particles is the result of heating and therefore thermal expansion of only some of the minerals within ore particles in response to microwave energy leading to micro-cracking or other physical changes within the ore particles.

Preferably the method includes exposing the ore particles to microwave energy and causing structural alteration of the ore particles without significantly altering the mineralogy, ie composition, of the ore.

Particularly in cases where the ore is to be leached in the subsequent processing step, preferably the method includes exposing the ore particles to microwave energy and causing structural alteration of the ore particles with minimal change to the sizes of the ore particles.

In this regard, the present invention is based in part on the realisation that microwave energy, particularly high energy microwave energy, can be used selectively to produce micro-cracks in ore particles that improve exposure of the ore to subsequent processing, such as by leaching, without substantially reducing the size of the particles. The latter point can be important in situations where coarse as opposed to fine particles are preferred in the subsequent processing and it is therefore undesirable for microwave energy treatment to cause break down of particles into fines. This is also attractive where leaching is used to remove a desired component from an ore and there are unwanted reactive components within the ore which consume excessive amounts of reagents if they are ground too finely. This is commonly the case in uranium ores where the recovery obtained is often limited by needing to balance the fineness of grinding of the material to enable the valuable minerals to leach versus the higher consumption of reagents at finer particle sizes.

The present invention is also based in part on the realisation that microwave energy, particularly high energy microwave energy, can be used to selectively produce micro-cracks in ore particles that make the particles susceptible to subsequent comminution to reduce the particle size of the particles that have micro-cracks to be within an optimum particle size range for subsequent processing of the ore. This is particularly important in situations where the ore particles that contain valuable components, such as metals, minerals or gemstones, are the most affected by the microwave energy treatment and break down preferentially into smaller size particles than the remainder of the ore particles and thereby allow separation of the valuable smaller particles from the remaining larger particles by simple physical means. This is also particularly important in the reverse situations where the unwanted material is susceptible to break down in response to exposure to microwave energy.

In some cases the ore particles which react to microwaves and break down may include unwanted impurities and can be separated to improve the value of the majority of the ore, such as in the case of iron ores where the method can be used to remove contaminants, such as phosphorus and aluminium.

The term "microwave energy", is herein understood to mean electromagnetic radiation that has frequencies in the range of 0.3-300 GHz.

The subsequent processing of the ore particles may include heap leaching of the particles.

By way of further example, the subsequent processing of the ore particles may include comminution of the particles to reduce the sizes of the particles to be within an optimum particle size range for subsequent processing of the ore. This step is particularly suitable for ores where the product is not a fine powder such as is the case for iron ore and diamonds. It can also be beneficial in reducing the amount of ore which needs to be ground finely for preparation of the final product if the composition of the different fractions can be directly measured and the components separated in a dry state. Online analysis systems such as Laser Induced Fluorescence, X-Ray Diffraction of Neutron Activation Analysis are particularly suitable for use in combination with the microwave energy treatment.

The method may include screening ore particles prior to exposing the ore particles to microwave energy in order to provide a preferred particle size distribution for subsequent microwave energy treatment.

Preferably the method includes screening ore particles prior to exposing the ore particles to microwave energy in order to remove fines from the ore particles.

Preferably the method includes exposing the ore particles to pulses of microwave energy.

In this regard, the present invention is also in part based on the realisation that the use of short pulses enables very high electric fields to be applied to the ore particles in a simple, much more effective, physical arrangement with the total energy supplied to the particles being controlled by the number and duration of the pulses and that this is advantageous outcome. Specifically, this is an advantageous outcome for some ore particles where high energy is needed to achieve sufficient micro-cracking and where, if the microwaves are supplied continuously, the particles have to be moved through the microwave field very quickly to avoid excessive exposure whilst still achieving the desired rapid localised heating and micro-cracking, in which case there can be limits on the energy of the microwaves used or else complex expensive equipment is needed to enable the exposure.

Preferably the ore is exposed to the microwaves within a cavity such as that disclosed within the International patent application WO02092162 in the name of the University of Stellenbosch which amplifies the electric field strength to further improve the efficiency of the exposure and maximises the micro-cracking. The disclosure in the International application is incorporated herein by cross-reference.

Preferably the microwave energy within the pulses has high energy to give rapid heating of susceptor minerals in the ore.

The term "high energy" is understood herein to mean values substantially above those within conventional household microwaves, ie substantially above 1 kW.

The use of pulsed microwave energy minimises the power requirements of the method and maximises thermal cycling of the ore particles.

By appropriate selection of operating conditions, pulsed microwave energy minimises heating of ore particles to temperatures at which there are changes to the mineralogy of the particles.

Preferably the pulsed microwave energy includes pulses of short duration.

The term "short duration" is understood herein to mean that the time period of each pulse is less than 1 second.

Preferably the pulse time period is less than 0.1 second.

More preferably the pulse time period is less than 0.001 second.

The time period between pulses of microwave energy may be set as required depending on a number of factors. One factor that is relevant in a number of situations is to ensure that there is no undue heating of the mass of ore particles which could cause composition changes to the ore. Preferably the time period between pulses is 10-20 times the pulse time period.

The particles may be exposed to one or more pulses of microwaves to achieve the desired level of micro-cracking. This can be achieved in a single installation which releases microwave energy in pulses. This can also be achieved in an installation having multiple exposure points at spaced intervals along a path of movement of the ore, with each of the exposure points releasing its own characteristic microwave energy in pulses or continuously.

In a situation in which the subsequent ore processing is heap leaching the ore, the main objective of exposing ore particles to microwave energy is to structurally alter the ore particles to improve access of a leach solution to ore particles.

Improved access to the leach solution may be the result of break down of ore particles into smaller particles.

However, in this application, preferably improved access to the leach solution is the result of structural weakening of ore particles that improves porosity of the particles without causing substantial particle break down.

The improvement in porosity resulting from microwave energy exposure makes it possible to use larger sized particles of a given ore type in heap leaching than would normally be the case with the ore type.

The width of the particle size range presented for microwave energy treatment may influence the extent of particle break down. Specifically, there may be a greater likelihood of particle break down with a wider particle size distribution than with a narrower particle size distribution.

Preferably the ore particles include microwave susceptor and non-susceptor components, whereby improved access to the leach solution is the result of structural changes at the interface of microwave susceptor and non-susceptor components of the ore components.

The ores of particular interest to the applicant are ores that contain valuable metals and the valuable metals are part of the microwave susceptor components of the ores.

Preferably the ores are ores in which the valuable metal is in present as a sulphide.

The applicant is interested particularly in copper-containing ores in which the copper is present as a sulphide, such as chalcopyrite or chalcocite.

The applicant is also interested in nickel-containing ores in which the nickel is present as a sulphide.

The applicant is also interested in uranium-containing ores.

The applicant is also interested in ores containing iron minerals where some of the iron minerals have disproportionately higher levels of unwanted impurities.

The applicant is also interested in diamond ores where the ore has a mix of diamond containing minerals and diamond barren minerals such as quartz.

Preferably the ore particles have a major dimension of 15 cm or less prior to exposure to microwave energy.

The wavelength of the microwave energy and the exposure time may be selected depending on relevant factors.

Relevant factors may include ore type, particle size, particle size distribution, and requirements for subsequent processing of the ore.

The method includes any suitable steps for exposing the ore to microwave energy.

One suitable option includes allowing the ore to free-fall down a transfer chute past a microwave energy generator.

The free-fall option is a preferred option to a forced feed option in a mining industry environment because of the materials handling issues that are often associated with the mining industry.

Preferably the method includes transporting the ore to an inlet end of the transfer chute on a conveyor and transporting the microwave-treated ore from an outlet end of the transfer chute on a conveyor.

According to the present invention there is also provided a method of recovering valuable components, such as a metal, from an ore including the steps of:

(a) treating ore particles by exposing ore particles to microwave energy and causing structural alteration of the ore particles, the structural alteration of the ore particles being a result of differences in thermal expansion of minerals within ore particles, as a consequence of exposure to microwave energy, resulting in regions of high stress/strain within the ore particles and leading to micro-cracking or other physical changes within the ore particles; and (b) processing the treated ore particles to recover the valuable components.

The processing step may be any suitable step, such as leaching the treated ore particles, for example by heap leaching, or comminuting and thereafter physically separating the ore particles into different size fractions.

BRIEF DESCRIPTION OF THE DRAWINGS

The present invention is described further by way of example with reference to the accompanying drawing which is a flow sheet of the sequence of steps in a preferred embodiment of a method of recovering a valuable component in the form of copper from copper-containing ores in which copper is present as the minerals chalcopyrite or chalcocite.

DETAILED DESCRIPTION OF THE INVENTION

With reference to the flow sheet, ore particles are supplied to a primary crusher 1 and are crushed to a particle size of 10-15 cm.

The crushed particles discharged from the primary crusher 1 are supplied via a conveyor (or other suitable transfer means) to a microwave energy treatment station 3 and are allowed to free fall past a microwave energy generator (not shown) that exposes the ore particles to high energy pulses of microwave energy.

The microwave energy causes localised heating of the susceptor components of the ore, such as the chalcopyrite and chalcocite minerals, in the ore and the differences in thermal expansion of the constituents of the ore produces regions of high stress/strain within the ore particles and causes micro-cracks to form in the particles, particularly particles containing chalcopyrite and chalcocite minerals.

The operating conditions, such as energy level, pulse duration, and exposure length are selected to ensure that the localised heating has minimal if any impact on the composition of the ore particles and does not cause catastrophic break down of the particles. With regard to the latter point, the objective of the microwave energy treatment step in most applications is to form micro-cracks that weaken but do not destroy the particles. Typically, with an input feed of 10-15 cm particles, the majority of the output will have a particle size from 1-15 cm, with a substantial proportion of the output being larger than 5 cm.

Depending on the circumstances, the microwave treated ores are supplied to a heap leaching station 5 and are subjected to leaching to recover copper into solution or to a comminution station 7 and are further crushed and if necessary ground to selectively reduce the particle size of the particles. The micro-cracks in the ore particles improve access for leach solution in the heap leaching step and reduce the energy required to produce an optimum particle size range in the subsequent crushing and grinding steps.

In particular, in situations such as the processing of ores containing chalcopyrite and chalcocite minerals, where the valuable metals are concentrated in susceptor materials, the crushing and grinding steps produce a smaller particle size fraction that contains a relatively high concentration of valuable metals and a larger particle size fraction that contains non-valuable material.

The ground ore from the comminution station 7 is supplied to a physical separator 9 that separates the larger and smaller particle size fractions to facilitate recovery of copper from the smaller size fraction.

Many modifications may be made to the preferred embodiment of the present invention described above without departing from the spirit and scope of the present invention.

The claims defining the invention are as follow:

1. A method of treating ore with microwave energy to facilitate subsequent processing of the ore, comprising the steps of:

a) supplying the ore to a primary crusher and crushing the ore;

b) discharging crushed ore particles from the primary crusher and feeding crushed ore particles with a major dimension of 15 cm or less to a microwave energy treatment station, having a microwave energy generator;

c) exposing the ore particles while passing through the microwave energy treatment station to high energy pulses of microwave energy substantially above 1 kW with each pulse being less than 0.1 sec to produce micro-cracking within the ore particles without catastrophic destruction of the ore particles; and d) thereafter feeding the microwave-exposed ore particles to a heap leach or a comminution station.

2. The method as defined in claim 1 wherein the crushed ore particles are supplied to the microwave energy treatment station on a conveyor and the microwave-exposed ore particles are taken away on a conveyor.

3. The method defined in claim 1 further including screening the crushed ore particles prior to exposing the ore particles to microwave energy in order to remove fines from the ore particles and to produce an output of microwave-exposed ore particles including a substantial proportion that has a particle size larger than 5 cm.

4. The method defined in claim 2 wherein the crushed ore particles are allowed to free fall while being exposed to the pulses from the microwave energy generator.

5. The method defined in claim 3 wherein the ore is an ore in which the valuable components are metals and the metals are present as a sulphide.

6. The method defined in claim 5 wherein the ore is a copper-containing ore in which the copper is present as a sulphide, such as chalcopyrite or chalcocite.

7. A method of treating ore with microwave energy to facilitate subsequent processing of the ore, comprising the steps of:

a) supplying the ore to a primary crusher and crushing the ore;

b) discharging crushed ore particles from the primary crusher and feeding crushed ore particles with a major dimension of 15 cm or less to a microwave energy treatment station, having a microwave energy generator;

c) exposing the ore particles while passing through the microwave energy treatment station to high energy pulses of microwave energy substantially above 1 kW with each pulse being less than 0.001 sec to produce micro-cracking within the ore particles without catastrophic destruction of the ore particles; and d) thereafter feeding the microwave-exposed ore particles to a heap leach or a comminution station.

8. The method as defined in claim 7 wherein the crushed ore particles are supplied to the microwave energy treatment station on a conveyor and the microwave-exposed ore particles are taken away on a conveyor.

9. The method defined in claim 7 further including screening the crushed ore particles prior to exposing the ore particles to microwave energy in order to remove fines from the ore particles and to produce an output of microwave-exposed ore particles including a substantial proportion that has a particle size larger than 5 cm.

10. The method defined in claim 8 wherein the crushed ore particles are allowed to free fall while being exposed to the pulses from the microwave energy generator.

11. The method defined in claim 9 wherein the ore is an ore in which the valuable components are metals and the metals are present as a sulphide.

12. The method defined in claim 11 wherein the ore is a copper-containing ore in which the copper is present as a sulphide, such as chalcopyrite or chalcocite.

13. A method of treating ore particles of 15 cm or less with microwave energy to facilitate subsequent processing of the ore in which the ore particles are exposed, while passing through a microwave energy treatment station, to high energy pulses of microwave energy substantially above 1 kW with each pulse being less than 0.001 sec to produce micro-cracking within the ore particles without catastrophic destruction of the ore particles.

14. The method defined in claim 13 wherein an output of microwave-exposed ore particles includes a substantial proportion that has a particle size larger than 5 cm.

* * * * *